US007473069B2

(12) United States Patent
Deichmann et al.

(10) Patent No.: US 7,473,069 B2
(45) Date of Patent: Jan. 6, 2009

(54) FUEL PUMP FOR A FUEL TANK

(75) Inventors: Johannes Deichmann, Alheim-Sterkelshausen (DE); Eberhard Geissel, Künzell (DE); Bernd Jaeger, Fritzlar (DE)

(73) Assignee: Siemens Aktiengesellschaft, München (DE)

( * ) Notice: Subject to any disclaimer, the term of this patent is extended or adjusted under 35 U.S.C. 154(b) by 635 days.

(21) Appl. No.: 10/935,647

(22) Filed: Sep. 7, 2004

(65) Prior Publication Data

US 2005/0074345 A1 Apr. 7, 2005

(30) Foreign Application Priority Data

Sep. 9, 2003 (DE) ..... 103 41 837

(51) Int. Cl.
*F04D 5/00* (2006.01)

(52) U.S. Cl. ..... 415/55.6; 415/55.7

(58) Field of Classification Search ..... 415/55.5, 415/55.6, 55.7, 55.1, 55.2, 55.3, 55.4, 59.1
See application file for complete search history.

(56) References Cited

U.S. PATENT DOCUMENTS

2001/0041132 A1* 11/2001 Marx et al. ..... 415/55.1
2003/0231953 A1* 12/2003 Ross ..... 415/55.1
2004/0223842 A1* 11/2004 Talaski ..... 415/55.5

FOREIGN PATENT DOCUMENTS

| | | |
|---|---|---|
| DE | 41 02 323 A1 | 7/1992 |
| DE | 100 13 908 A1 | 9/2001 |
| DE | 197 25 249 C2 | 5/2002 |

* cited by examiner

*Primary Examiner*—Richard Edgar
(74) *Attorney, Agent, or Firm*—Cohen Pontani Lieberman & Pavane LLP

(57) ABSTRACT

In a fuel pump (6) designed as a side channel pump, in each case two conveying chambers (20-23) one surrounding the other concentrically are arranged on two impellers (9, 10). The conveying chambers (20, 21) of one impeller (9) are connected to an inlet duct (25), while the conveying chambers (22, 23) of the other impeller (10) are connected to an outlet duct (26). A connection (24) of the conveying chambers (20-23) is arranged in a partition (17) keeping the impellers (9, 10) at a distance from one another. As a result, the fuel pump (6) has an especially high volume flow, along with a very high conveying pressure.

7 Claims, 2 Drawing Sheets

FUEL PUMP FOR A FUEL TANK

BACKGROUND OF THE INVENTION

The invention relates to a fuel pump for a fuel tank of a motor vehicle, with an impeller arranged rotatably in a casing, with at least two rings, arranged in the two end faces of the impeller and one surrounding the other concentrically, of guide blades which delimit blade chambers, blade chambers located opposite one another being connected to one another, and with part-annular channels, arranged in the casing and located opposite the guide blades, for the formation of conveying chambers, one surrounding the other concentrically, for the conveyance of fuel from an inlet duct to an outlet duct.

Such fuel pumps are often used for the conveyance of fuel from fuel tanks to internal combustion engines of present-day motor vehicles and are known from practice. In the known fuel pump, one of the conveying chambers of the known fuel pump leads to the outlet duct and the other of the conveying chambers leads to an outlet, via which, for example, a suction jet pump is supplied with fuel. For the present-day high-performance internal combustion engines, however, it is necessary for the conveying chamber leading to the outlet duct to have a very large cross section. This results in a very large axial overall height of the fuel pump. Since the fuel tanks of present-day motor vehicles usually have a very low and angled configuration, however, only fuel pumps with an especially low overall height can be used. In practice, this is remedied by employing a plurality of fuel pumps in the fuel tank. This, however, leads to a highly cost-intensive outlay in the fuel tank.

The problem on which the invention is based is to configure a fuel pump of the type initially mentioned in such a way that it has especially small axial dimensions and has as high a conveying volume as possible.

BRIEF DESCRIPTION OF THE INVENTION

This problem is solved, according to the invention, in that the two conveying chambers are connected in each case to a common inlet duct and to a common outlet duct.

By virtue of this configuration, the two conveying chambers are arranged parallel to one another. A cross section necessary for the conveyance of a high volume flow is distributed, owing to the invention, to two conveying chambers. These conveying chambers can have substantially smaller dimensions in the axial direction than a single conveying chamber. Consequently, by means of the single fuel pump according to the invention, an especially high-performance internal combustion engine can be supplied with fuel.

According to another advantageous development of the invention, a contribution to further increasing the conveying pressure and in the case of a high conveying volume is made when two impellers are arranged on a common shaft and are held at a distance from one another by means of a partition, and when conveying chambers one surrounding the other concentrically are arranged in each case on the impellers, and when the conveying chambers of one impeller have a connection to the conveying chambers of the other impeller in the partition, and when the conveying chambers of one of the impellers are connected to the inlet duct and the conveying chambers of the other of the impellers are connected to the outlet duct. Tests have shown that, by means of the fuel pump according to the invention, conveying volumes of above 300 l/h with a conveying pressure of more than 8 bar can be generated.

According to another advantageous development of the invention, a different pressure build-up of the two conveying chambers of the impeller arranged nearest to the inlet duct can be evened out in a simple way when a connection in the partition connects all the conveying chambers of the two impellers to one another.

According to another advantageous development of the invention, a uniform acceleration of the flows in the conveying chambers between the inlet duct and the outlet duct can be achieved in a simple way when the partition has two connections and when in each case the radially inner of the conveying chambers of one impeller is connected to the radially outer conveying chamber of the other impeller.

According to another advantageous development of the invention, the fuel pump according to the invention can be manufactured in an especially simple way when in each case the radially outer conveying chambers and the radially inner conveying chambers are connected to one another. By virtue of this configuration, the connections can penetrate through the partition along a straight path.

According to another advantageous development of the invention, turbulences in the inlet duct can be avoided in a simple way when the inlet duct has a web for dividing the conveying chambers.

According to another advantageous development of the invention, turbulences in the outlet duct can be avoided in a simple way when the outlet duct has a web for dividing the conveying chambers.

According to another advantageous development of the invention, the supply of fuel to a suction jet pump requires an especially low outlay in structural terms when the impeller arranged at the inlet duct has a further conveying chamber arranged concentrically to the other conveying chambers and separated from these and when the further conveying chamber has its own outlet.

BRIEF DESCRIPTION OF THE DRAWINGS

The invention permits numerous embodiments. To make the invention even clearer, three of these are illustrated in the drawing and are described below. In the drawing.

DETAILED DESCRIPTION OF THE INVENTION

Figure 1:
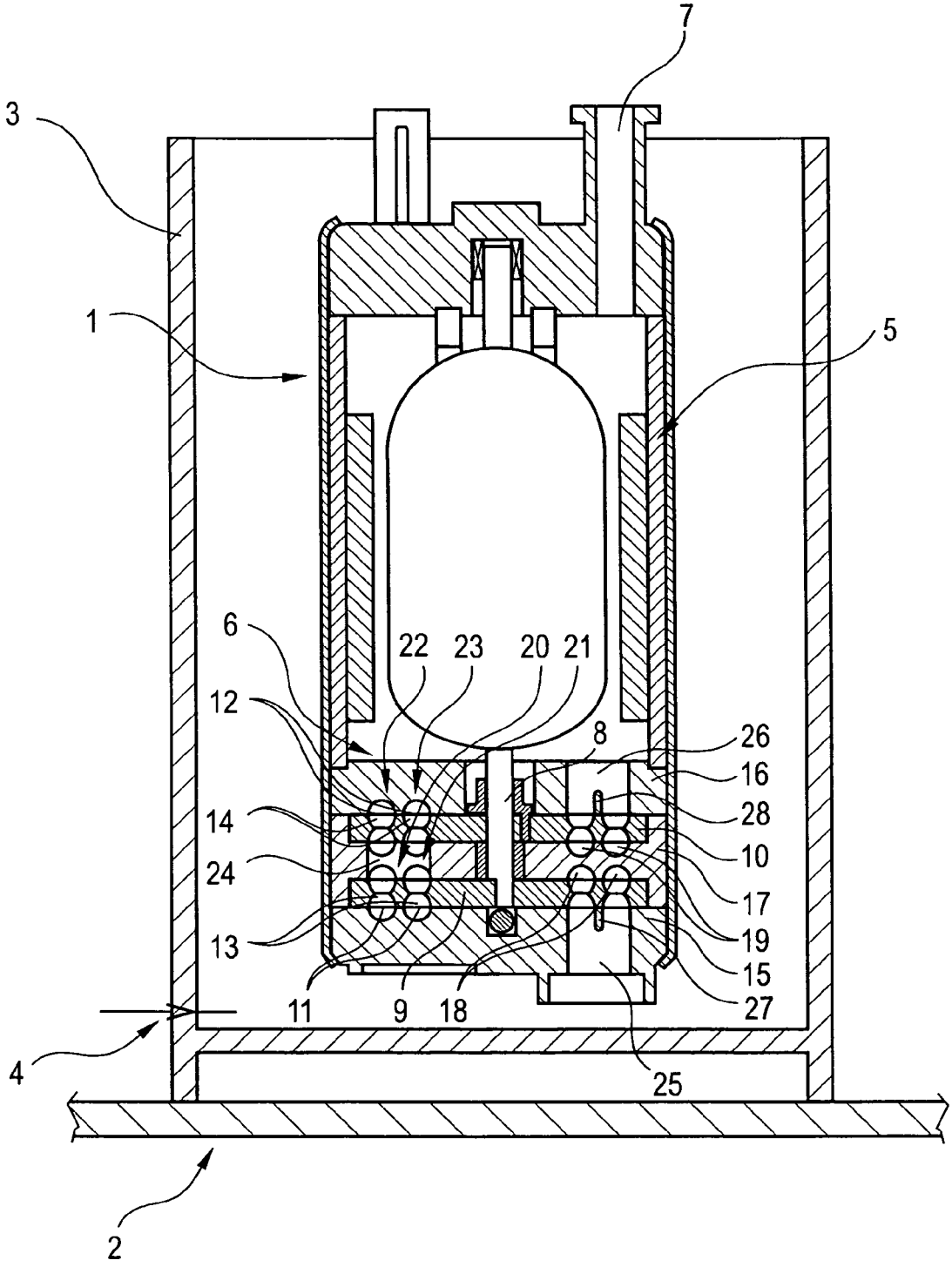
FIG. 1 shows a longitudinal section through a conveying unit with a fuel pump according to the invention.

FIG. 1 shows a longitudinal section through a conveying unit 1 for the conveyance of fuel out of a fuel tank 2 to an internal combustion engine, not illustrated, of a motor vehicle. The conveying unit 1 is arranged in a baffle 3 prestressed against a bottom region of the fuel tank 2. The baffle 3 is filled with fuel from the fuel tank 2 via a suction jet pump 4. The conveying unit 1 has a fuel pump 6 driven by an electric motor 5 and a connection piece 7 for a fuel line leading to the internal combustion engine and the suction jet pump 4. The fuel pump 6 has two impellers 9, 10 arranged fixedly in terms of rotation on a shaft 8 of the electric motor 5, in each case with two rings, one surrounding the other concentrically, of guide blades 11, 12 which delimit blade chambers 13, 14. Blade chambers 13, 14, located opposite one another, of each of the impellers 9, 10 are connected to one another. The flow consequently passes through the impellers 9, 10 axially. The impellers 9, 10 are in each case mounted axially between a casing part 15, 16 and a partition 17. The blade chambers 13, 14 form, with part-annular channels 18, 19 arranged in the partition 17 and the casing parts 15, 16, in each case a conveying chamber 20-23. A connection 24 for the four conveying chambers 20-23 is arranged in the partition 17. The conveying chambers 20, 21 of one impeller 9 are connected to an inlet duct 25, whilst the conveying chambers 22, 23 of the other impeller 10 are connected to an outlet duct 26. The inlet duct 25 and the outlet duct 26 in each case penetrate through one of the casing parts 15, 16 and in each case have a web 27, 28. The web 27, 28 separates the fuel conveyed in the conveying chambers 20-23.

Figure 2:
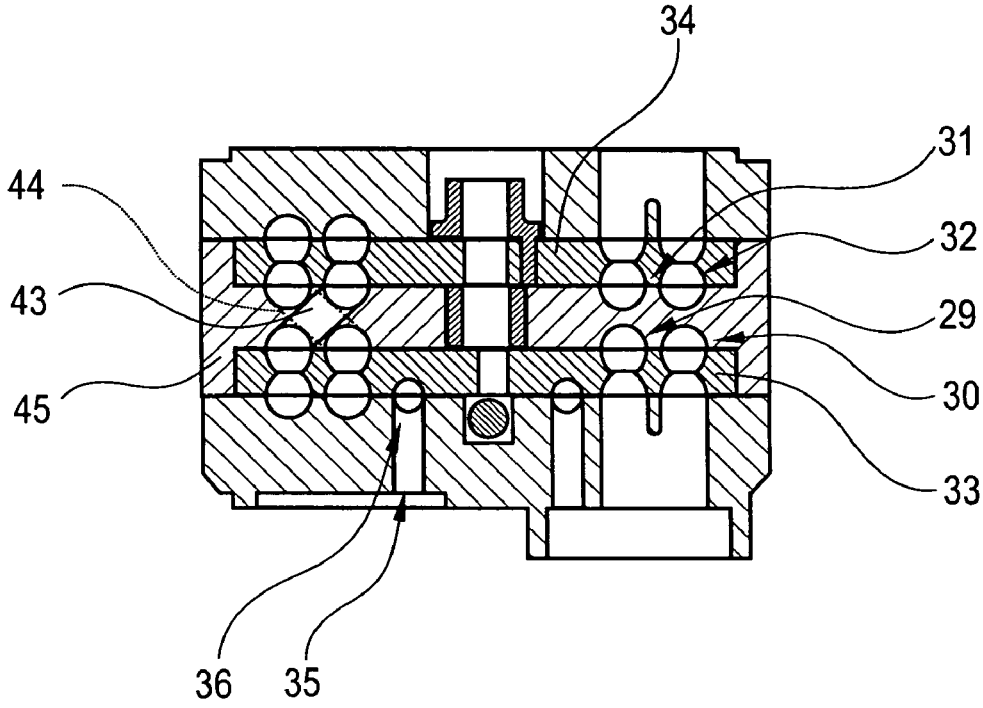
FIG. 2 shows a diagrammatic sectional illustration of a further embodiment of the fuel pump according to the invention.

FIG. 2 shows diagrammatically a further embodiment of the fuel pump according to the invention. This differs from that of FIG. 1, above all, in that a radially inner conveying chamber 29, 31 of a first impeller 33 is connected to a radially outer conveying chamber 30, 32 of a second impeller 34. Furthermore, one of the impellers 33 has a further conveying chamber 36 led to an outlet 35. A further consumer, such as, for example, the suction jet pump 4 illustrated in FIG. 1, can be supplied with fuel as propellant via this further conveying chamber 36. A partition 45 keeping the impellers 33, 34 at a distance from one another has two crossed connections 43, 44. These connections 43, 44 are arranged so as to be offset to one another in the direction of rotation of the impellers 33, 34.

Figure 3:
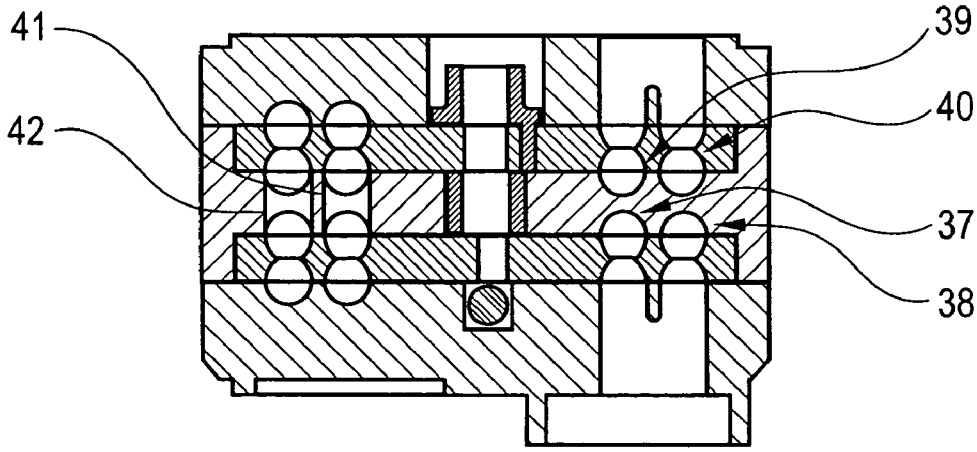
FIG. 3 shows a diagrammatic sectional illustration of a further embodiment of the fuel pump according to the invention.

FIG. 3 shows diagrammatically a further embodiment of the fuel pump according to the invention, in which in each case two conveying chambers 37-40 one surrounding the other concentrically have two straight connections 41, 42 separated from one another. The fuel pump is otherwise constructed in the same way as described with reference to FIG. 1.

The connections 24, 41-44 between the conveying chambers 20-23, 29-32, 37-40 and also the inlet ducts (25) and outlet ducts (26) are in each case illustrated as being rotated into the drawing plane in order to make the drawing clearer. In actual fact, the conveying chambers 20-23, 29-32, 37-40 extend mostly over an angular range of approximately 300° to 330°.

The invention claimed is:

1. A fuel pump for a fuel tank of a motor vehicle, comprising:

a casing with two impellers arranged rotatably therein and held at a distance from one another by a partition; and at least two rings of guide blades, which delimit blade chambers located opposite one another in one of the two impellers, arranged in two end faces of each of the two impellers, one of said guide blades concentrically surrounding another of said guide blades;

wherein the blade chambers being connected to one another, and the casing defining part-annular channels located opposite the at least two rings of guide blades, for formation of two conveying chambers, one surrounding the other concentrically, for conveying fuel from an inlet duct to an outlet duct defined in the casing; and wherein conveying chambers of one of the two impellers have a connection to the conveying chambers of the other of the two impellers in the partition, the connection is radially arranged in a region of the two conveying chambers, and the conveying chambers of the one of the two impellers are connected to a common inlet duct and the conveying chambers of the other of the two impellers are connected to a common outlet duct.

2. The fuel pump as claimed in claim 1, wherein a connection in the partition connects all the conveying chambers of the two impellers to one another.

3. The fuel pump as claimed in claim 1, wherein the conveying chambers of each of the two impellers include a radially inner and a radially outer conveying chamber, the partition has two connections, and in that in each case the radially inner of the conveying chambers of one impeller is connected to the radially outer conveying chamber of the other impeller.

4. The fuel pump as claimed in claim 1, wherein the conveying chambers of each of the two impellers include a radially inner and a radially outer conveying chamber, in each case the radially outer conveying chambers and the radially inner conveying chambers are connected to one another.

5. The fuel pump as claimed in claim 1, wherein the inlet duct has a web for dividing the conveying chambers.

6. The fuel pump as claimed in claim 1, wherein the outlet duct has a web for dividing the conveying chambers.

7. The fuel pump as claimed in claim 1, wherein an impeller arranged at the inlet duct has a further conveying chamber arranged concentrically to the other conveying chambers and is separated from these, and in that the further conveying chamber has its own outlet.

* * * * *